United States Patent [19]

Hansen et al.

[11] Patent Number: 4,759,300

[45] Date of Patent: Jul. 26, 1988

[54] METHOD AND APPARATUS FOR THE PYROLYSIS OF WASTE PRODUCTS

[75] Inventors: Andrew H. Hansen, Van Nuys; William C. Walker, Buena Park; Richard K. Walker, Pinole, all of Calif.

[73] Assignee: Balboa Pacific Corporation, Sante Fe Springs, Calif.

[21] Appl. No.: 111,430

[22] Filed: Oct. 22, 1987

[51] Int. Cl.[4] ..... F23G 5/12

[52] U.S. Cl. ..... 110/229; 48/76; 48/203; 110/224; 110/227; 110/238; 110/242; 110/250; 110/257; 110/346; 202/118

[58] Field of Search ..... 110/229, 250, 224, 346, 110/227, 228, 257, 242, 238; 202/118; 48/76, 89, 119, 203

[56] References Cited

U.S. PATENT DOCUMENTS

| | | | |
|---|---|---|---|
| 3,110,652 | 11/1963 | Thomsen | 202/118 X |
| 4,084,521 | 4/1978 | Herbold et al. | 110/242 |
| 4,361,100 | 11/1982 | Ainger | 110/229 X |
| 4,432,290 | 2/1984 | Ishii et al. | 110/224 X |

*Primary Examiner*—Edward G. Favors

*Attorney, Agent, or Firm*—James E. Brunton

[57] ABSTRACT

A method and apparatus for use in processing waste materials of various kinds and for reclaiming useable by-product materials from the pyrolized waste materials. The waste materials to be pyrolized are efficiently dehydrated prior to their introduction into the pyrolysis retort using microwaves generated by a large microwave generator. After the waste material is dried, initial ignition is accomplished using a very high intensity laser beam. Laser ignition is continued until sufficient methane and other volatile gases are produced for burning in a burner unit to sustain the pyrolysis reaction.

10 Claims, 2 Drawing Sheets

FIG. 2
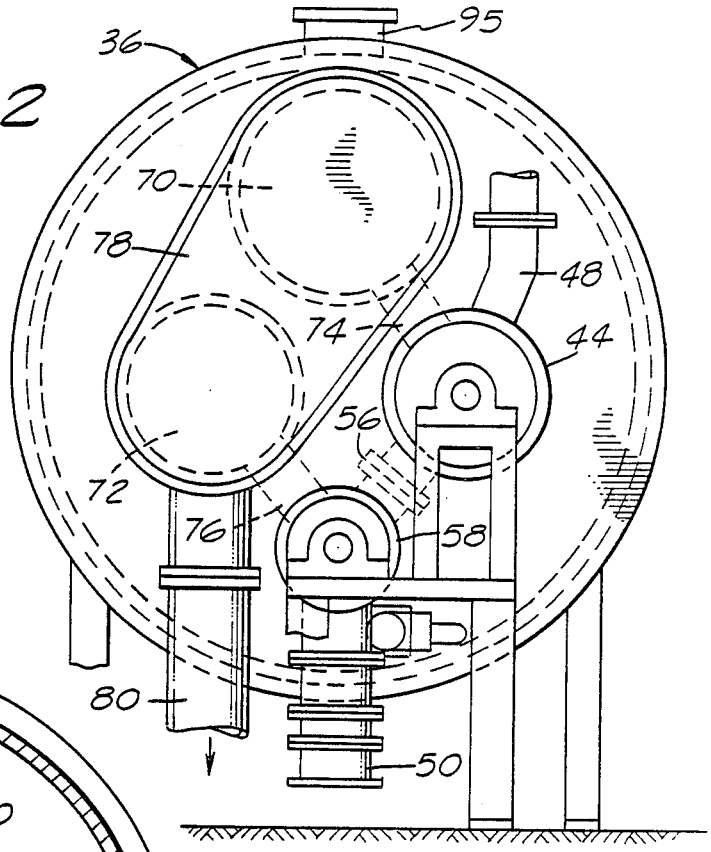
FIG. 3
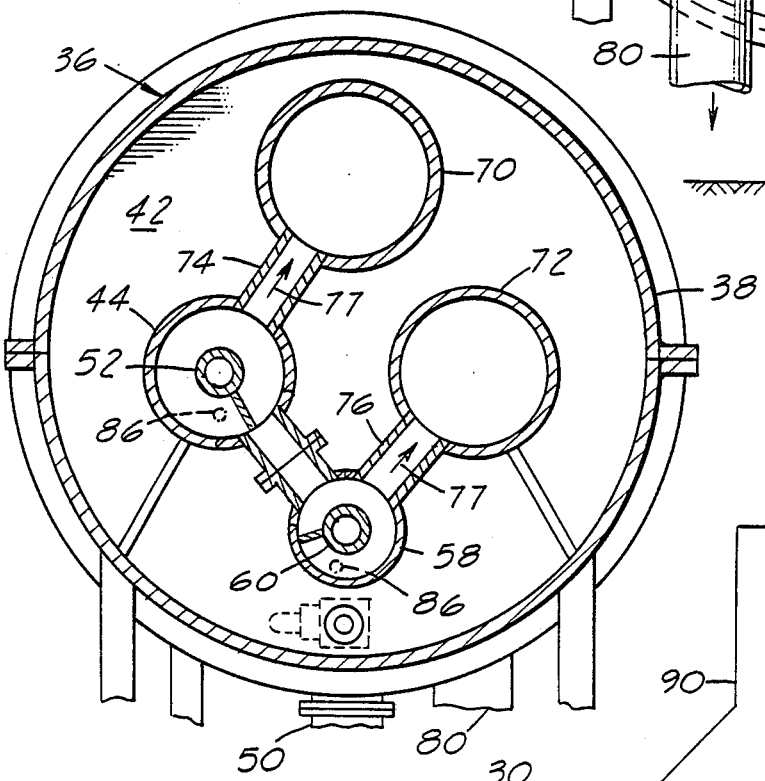
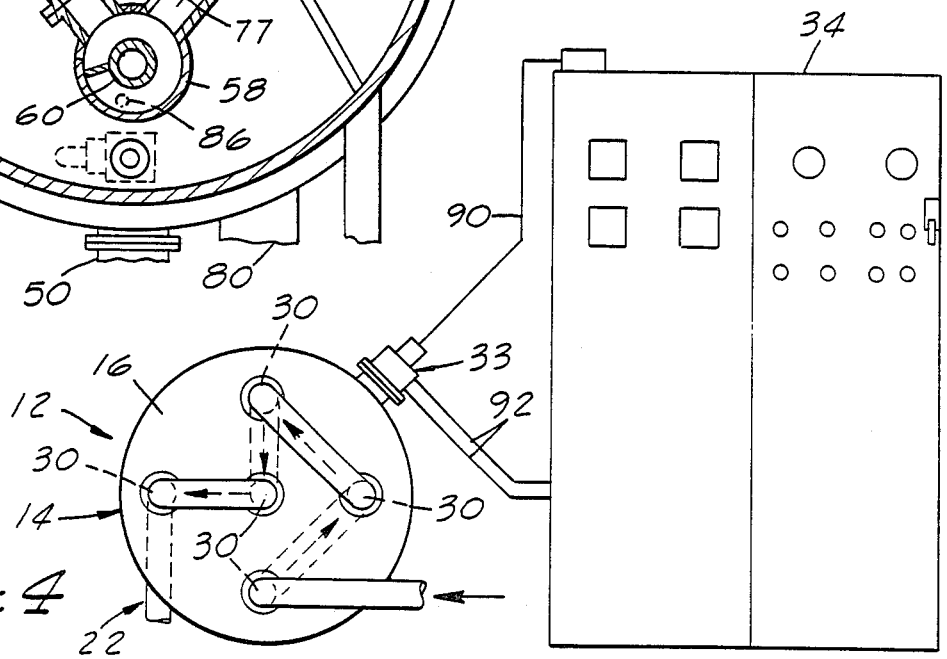
FIG. 4

METHOD AND APPARATUS FOR THE PYROLYSIS OF WASTE PRODUCTS

BACKGROUND OF THE INVENTION

1. Field of the Invention

The present invention relates generally to a method and apparatus for pyrolyzing of waste materials. More particularly, the invention concerns a method and apparatus for pyrolyzing a wide variety of substances in either a liquid, sludge, solid or mixed state.

2. Discussion of the Prior Art

Various methods and apparatus for pyrolyzing waste materials have been suggested in the past. Typically pyrolytic decomposition of waste materials is carried out in an atmosphere which is kept substantially oxygen free by exclusion of air. As a general rule, the waste is pyrolyzed in a closed retort maintained at elevated temperatures in the range of between 400° C. and 800° C.

In recent years considerable effort has been devoted to perfecting the design of large, highly efficient, relatively polution free pyrolysis equipment for use in the pyrolysis of various types of waste materials including domestic and industrial waste. For example, in U.S. Pat. No. 4,084,521 issued to Herbold, et al, a method and apparatus for the pyrolysis of old tires and other vulcanized waste products of rubber or plastic is disclosed. In the relatively early U.S. Pat. No. 3,020,212 issued to Lantz, a pyrolytic refuse converter for use in pyrolyzong domestic and industrial waste is disclosed.

One of the drawbacks of most of the prior art methods and apparatus for pyrolysis of waste products resides in the inability of the apparatus to efficiently process waste products materials in the liquid form or waste products embodying large amounts of moisture. When such materials are introduced into the pyrolysis chamber, substantial energy is required to maintain the elevated temperature required to efficiently pyrolyze the materials. A particular problem encountered in processing such materials concerns the start up of the pyrolyis process.

One of the by-products of the decomposition of most domestic and industrial waste is methane gas. Accordingly, once proper start-up is accomplished, the pyrolysis process can be sustained by burning the methane gases produced by the process. However, start-up must be accomplished using an outside energy source such as natural gas or the like. Experience has shown that unless the waste products are properly treated before being introduced into the pyrolysis apparatus, the time required to achieve a self-sustaining reaction is inordinately long and, on occasion, the production of by-product methane gas remains insufficient to sustain the reaction without the addition of natural gases or other sources of energy. This inability to achieve a self-sustaining reaction can be extremely costly. Further, unless the waste materials within the retort are thoroughly decomposed, polution levels can become inordinately high.

As will be better understood from the description which follows, the method and apparatus of the present invention solves many of the drawbacks of prior art pyrolysis techniques by providing an apparatus wherein the waste material is pre-treated through the use of microwaves to preprocess the waste material prior to its introduction into the pyrolysis chamber. By carefully pre-processing the waste products start-up time is minimized so that the methane and other volatile gases which are produced as a result of the decomposition of the waste materials can be used relatively soon in the process to sustain the reaction.

In starting up the pyrolysis process, prior art apparatus typically used natural gas as the source of energy to initially ignite the waste material and pyrolyze it to a point that the production of methane gas was sufficient to sustain the pyrolysis reaction. This approach is costly and time consuming. In remote locations where natural gas is not available even more expensive propane or the like must be used. In the apparatus of the present invention, pre-ignition is uniquely is accomplished using energy derived from a high-powered, apparatus for light amplification by simulated emission of radiation commonly known as an industrial "laser". This device efficiently raises the temperature of the waste material to ignition temperatures and rapidly brings the apparatus to an operating point wherein the methane gas produced from the waste material being paralyzed is more than sufficient to sustain the pyrolysis reaction. In point of fact, additional volatile gases, over and above that necessary to sustain the reaction, is quickly produced. This excess produced gas can be used for a variety of purposes such as powering electrical generation equipment for the generation of electricity for use on or off the premises.

Basically the process of the present invention involves a introduction of waste material from a holding tank by means of a suitable material moving means such as a pumping apparatus. The pumping apparatus provides for a constant flow of waste material into the pre-processing or dehydrating apparatus wherein the material is subjected to microwaves produced by a large microwave generator. Following pre-drying of the waste, the waste material is then metered into the pyrolysis retort where it is controllably conveyed longitudinally of the retort by means such as a rotating, high temperature alloy helical screw.

Initial ignition of the pre-processed waste material is accomplished in a hypoxic, or oxygen-free, chamber of the retort by means of the high powered, industrial scale ruby or CO2 laser. High energy laser radiation is directed at the predried waste material and is continued until sufficient volatile gases are produced from the decomposition of the waste material to sustain the reaction. The produced gases are continuously collected and then burned in one or more gas burners disposed within the retort proximate the pyrolysis chambers.

The process material, which will not gasify, is conveyed to the exit end of the retort and dropped through an airlock onto a secondary conveyer which transports it to a storage bin. As previously mentioned, the excess volatile gases produced by the apparatus are available for power generation through a variety of systems. For example, if a plant where the pyrolysis retort is located has a boiler, furnace or after-burner, the methane gas can be directly fired into the after-burner and the resultant heat energy produced used to reduce the need for other conventional sources. Because the by-product carbon char produced by the pyrolytic converter is inert, it can be readily disposed of in an ordinary landfill or can be salvaged for a variety of other commercial purposes.

SUMMARY OF THE INVENTION

It is an object of the present invention to provide an improved pyrolytic converter for use in processing waste materials of various kinds and for reclaiming useable by-product materials from the pyrolyzed waste materials.

Another object of the invention is to provide a pyrolythic converter apparatus wherein the waste materials to be pyrolyzed is dehydrated using microwaves generated by a large microwave generator.

Another object of the invention is to provide a pyrolytic converter of the character described in which, after the waste material is dried and introduced into the pyrolysis retort, initial ignition of the material is accomplished using a very high intensity laser beam.

A further object of the invention is the provision of a fully automated pyrolytic conversion unit which can be operated with a minimum of supervision.

Still another object of the invention is to provide a method and apparatus for the pyrolysis of waste of the character described in the preceding paragraphs, which is reliable and efficient in operation and one which will produce high quality fully recoverable by-products, including methane gas and high quality carbon char.

BRIEF DESCRIPTION OF THE DRAWINGS

FIG. 2 is a view taken along lines 2—2 of FIG. 1.

FIG. 3 is a cross-sectional view taken along lines 3—3 of FIG. 1.

FIG. 4 is a generally schematic view illustrating the pre-processing apparatus of the invention coupled with a microwave power generation control means.

DECSRIPTION OF THE INVENTION

Figure 1:
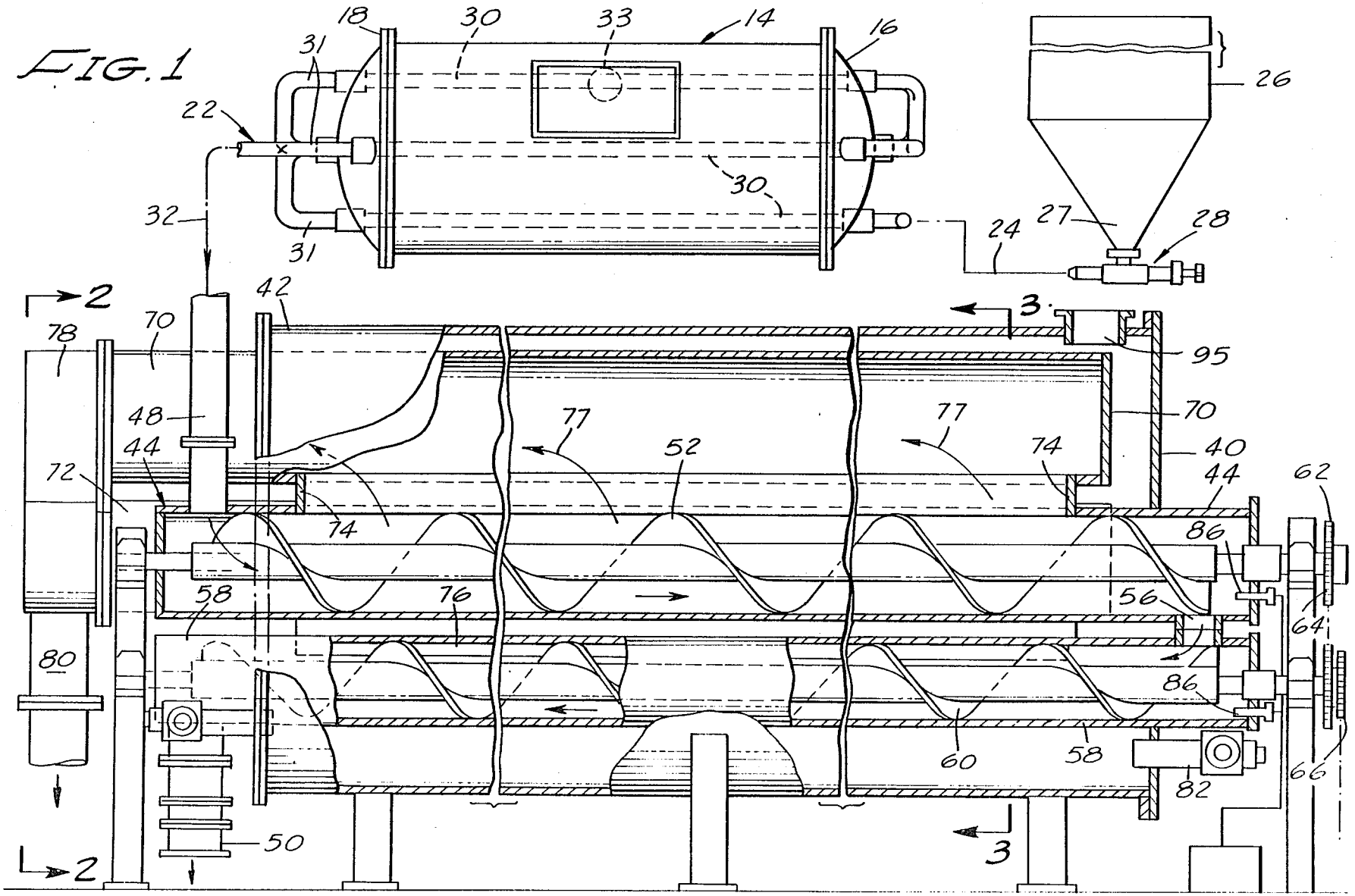
FIG. 1 is a side elevational view, partly in cross-section of the apparatus of the invention.

Referring to the drawings, and particularly to FIG. 1, the apparatus of the present invention for pyrolyzing waste sludge material is there shown. In this form of the invention, the apparatus includes a pre-processing or dehydrating subassembly 12 comprising an elongated first generally cylindrically shaped housing 14 having first and second end portions 16 and 18 respectively. Provided proximate the first portion of housing 14 is a waste inlet 20. Provided proximate the second end portion 18 of the first housing is a waste outlet 22. Waste inlet 20 is interconnected by means of a conduit 24 (indicated by the broken lines in FIG. 1) with a reservoir 26 for containing the waste sludge material to be pyrolyzed. Provided proximate the lower outlet end 27 of reservoir 26 is moving, or pump, means for moving the waste sludge material contained within reservoir 26 through the pre processing subassembly 12. In the embodiment of the invention shown in the drawings, the moving means is provided in the form of a hydraulic pump unit 28 which has sufficient capacity to force the waste sludge material through a plurality of interconnected waste carrying conduits 30 extending longitudinally of first housing 14. One of the conduits 30 is in communication with waste inlet 20 which, in turn, is in communication with conduit 24. Another of the conduits 30 is in communication with outlet 22 of housing 14.

As best seen be referring to FIGS. 1 and 4, conduits 30 comprise five elongated tubular members which extend longitudinally of first housing 14 in a generally parallel relationship. The lengths of conduit are interconnected to form a continuous flow path so as to permit the flow of the sludge material through the preprocessing subassembly in the direction generally indicated by the arrows in FIG. 4. As seen in the upper left hand portion of FIG. 1, the outlet end of the conduits 30 are interconnected by means of short conduits 31 which conduits are in turn in communication with an outlet conduit 32 indicated in FIG. 1 by the broken lines.

Turning to FIG. 4, it can be seen that a microwave generator means depicted here as a microwave generator 33 is mounted on the outer walls of housing 14 intermediate first and second ends 16 and 18 thereof, respectively. This microwave generator is operably associated with suitable power generation equipment 34, and, as will be described heretofore, functions to efficiently dehydrate the waste material flowing through conduits 30.

The pyrolytic retort subassembly of the present form of the invention, is generally designated in FIGS. 1 and 3 by the numeral 36, and comprises an elongated second housing 38 having first and second end portions 40 and 42 respectively. Extending longitudinally of second housing 38 is a pair of operably interconnected, generally cylindrically shaped pipes 44 and 58, respectively. Each of the pipes 44 and 58 contains an atmosphere substantially free of oxygen. As best seen in FIG. 1, pipe 44 is provided proximate the second end of housing 36 with an inlet 48 which is in communication with conduit 32. Similarly, pipe 58 is in communication proximate the lower portion of the second end of housing 36 with an outlet port 50.

With this arrangement, the dehydrated waste material is received from the pre-processing subassembly 12 via conduit 32 and enters pipe 44 through inlet 48. The dehydrated waste material is then moved longitudinally through pipe 44 by means of an elongated ribbon type helical screw 52 which is rotatably mounted within pipe 44.

In a manner presently to be described, the dehydrated waste material is controllably pyrolized as it moves longitudinally through pipe 44. When the material reaches the right end of pipe 44, as viewed in FIG. 1, it will fall by force of gravity through an inlet port 56 into a second longitudinally extending pipe 58. The partially pyrolized waste material is then moved longitudinally through pipe 58 by means of a second elongated ribbon type helical screw 60 which is rotatably mounted within pipe 58. Helical screws 52 and 60 are controllably rotated by a drive means provided at the right end of the retort subassembly as viewed in FIG. 1. Various types of drive means can be used to controllably rotate the helical screws or augers. However, in this form of the invention, the drive means is shown as comprising first and second operably interconnected sprockets 62 and 64. Sprocket 64 is driven by a sprocket 66 which sprocket is in turn driven by any suitable motor-means such as an electric motor or an internal combustion engine (not shown). Drive means of the character required for controllably rotating the helical screws are well known to those skilled in the art and the details thereof will not be described herein.

Turning now to FIG. 3, mounted within second housing 38, is gas recovery means associated with pipes 44 and 58 for recovering gases produced from the pyrolysis of the dehydrated waste material conveyed through the pipes by the helical screws 52 and 60. In the embodiment of the invention shown in the drawings, this gas recovery means comprises a pair of longitudinally extending conduits 70 and 72. Conduits 70 and 72 are generally tubular in configuration and extend substantially parallel to one another in an axially offset relationship with respect to conduits 44 and 58. Conduit 70 is interconnected intermediate its ends with pipe 44 by means of a passageway 74. Similarly, conduit 72 is interconnected intermediate its ends with pipe 58 by a passageway 76. As indicated by the arrow 77 in FIGS. 1 and 3, gases produced as a result of the pyrolysis of the waste flowing through the pyrolysis chambers or pipes 44 and 58, continuously flow into the gas recovery means or conduits 70 and 72.

As indicated in FIGS. 1 and 2, conduits 70 and 72 are interconnected proximate their left ends as viewed in FIG. 1 with a gas recovery bonnet or enclosure 78 which in turn is interconnected with an outlet pipe 80. Outlet pipe 80 is preferably interconnected with a produced gas storage tank (not shown) from which gases can be drawn to fire the gas burners of the apparatus presently to be described.

Mounted at the lower portion of second housing 36 is a burner means for burning the produced methane gas in a manner as to raise the interior of housing 36 to an elevated temperature sufficient to pyrolyze the waste material being conveyed through pipes 44 and 58. The embodiment of the invention shown in the drawings, this gas burner comprises a 2,500,000 btu gas burner 82 adapted to direct a gas flame longitudinally of housing 38 at a location below pipes 44 and 58. As previously mentioned, when the apparatus is fully operable, ample produced gas is generated to sustain pyrolysis reaction. Nevertheless, gas burner 82 in addition to being interconnected to the reservoir containing the produced gas, is also preferably interconnected with a source of natural gas or other auxiliary fuel (not shown).

Forming an important aspect of the present form the apparatus of the present invention, is igniter means carried by second housing 36 for generating a coherent beam of high intensity light and directing it toward the dehydrated waste entering pipes 44 and 58. In the embodiment of the invention hereshown, the ignitor means comprises an industrial type molecular oscillator 86 of a CO2 or ruby character and being capable of generating a coherent beam of light of sufficient intensity to pyrolyze the dehydrated waste material flowing into the retort. The ignitor means used in connection with the apparatus of the present invention is readily commercially available and its construction and operation is well understood by those skilled in the art. While several different manufacturers can provide laser equipment suitable for the present application, equipment manufactured by the Penn Research Corporation of Kenasaw, Ga. or by the Combustion Engineering Company of Summerville, Me., is satisfactory for use in connection with the apparatus shown in the drawings and described in the preceding paragraphs.

OPERATIONS

In the operation of the apparatus of the present invention, the sludge waste material to be pyrolyzed is stored within reservoir 26 and is pumped therefrom by pump 28 which may be a moyno-type pump. Pump 28 provides for a constant flow of the sludge or process material through conduit 24 into inlet 20 of the pre-processing unit and through the longitudinally extending conduit 30.

As the process material flows through the preprocessing unit, the microwave generator 33 is activated, radiating the interior of housing 14. The microwave radiation vibrates the organic matter of the process material causing internal frictional heating. This frictional heating functions to effectively dehydrate the process material so that when the material reaches the outlet 22 of the pre-processing chamber, virtually all the moisture contained within the process material has been removed.

Referring to FIG. 4, the microwave generating apparatus of the present invention comprises the generator or magnitron tube launcher 33 which is powered by the power generation unit 34 via a power transmission cable 90. The microwave generating equipment also includes a coolant system to enable the magnitron tube to be continuously cooled via coolent lines 92. The entire microwave generating equipment is of a character well understood by those skilled in the art and is readily commercially available as a complete unit. Manufacturers of equipment suitable for use in connection with the apparatus of the present invention include Gerling Laboratories of Modesto, Calif., MicroDry of San Ramon, Calif., and PSC Inc., Power Systems, of Cleveland, Ohio. The microwave generating equipment, forming in and of itself no part of the present invention, will not be described in detail herein. However, information concerning the operating and structural details of the equipment is available from the previous identified manufacturers.

After the sludge or process material has been preprocessed in the dehydrating or pre-processing subassembly 12, the dehydrated material will be transferred into the double retort pyrolysis of the invention via inlet 48. Material passing through inlet 48 will be introduced into pipe 44 and will be conveyed therethrough by means of helical screw 52. As the material is moved into pipe 44, it will be initially ignited by means of the ignitor means shown here in the form of the laser apparatus 86. The ignited process material will continue to pass through pipe 44 and will then be transferred to pipe 58 where it will be conveyed in the opposite direction by helical screw 60. Initial pyrolysis of this material is continued through use of the laser apparatus until such time as methane gas is produced in sufficient quantities to sustain the pyrolytic reaction.

As previously mentioned, during the initial pyrolysis process, the methane and other volatile gases are transferred to the gas recovery systems including conduits 70 and 72 and is transferred to a storage tank via outlet pipe 80. From the storage tank, which is not shown in the drawings, sufficient gas is drawn to fire gas burner 82 in a manner to maintain the internal temperature of housing 36 at a temperature sufficient to pyrolyze the processed material as it is introduced into the double retort system from the pre-processing subassembly 12.

The exhaust gases from the burner 82 are vented from the apparatus through a vent port 95 located in the top of housing 36.

The non-gaseous by-products produced as a result of the pyrolysis process, such as char and other solid materials, are conveyed to the exit end of the retort and dropped through outlet 50 which comprises an airlock and also a means by which the double retort can be evacuated or charged with carbon dioxide so as to maintain the substantially oxygen-free atmosphere within the retort. The solid materials, such as carbon char, passing through the outlet 50 can be recovered and disposed of in a landfill or alternately can be recovered for use in a variety of commercial applications.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A pyrolytic converter for pyrolyzing waste material comprising:

(a) an elongated first housing having a waste inlet and a waste outlet;

(b) at least one waste carrying conduit extending longitudinally of said first housing, said conduit having a first end in communication with said waste inlet of said first housing and a second end in communication with said waste outlet;

(c) moving means for moving waste longitudinally of said waste carrying conduit;

(d) microwave generator means carried by said first housing for treating and dehydrating with microwaves the waste material carried within said waste carrying conduit;

(e) an elongated, second housing having at least one pipe extending longitudinally thereof, said pipe containing an atmosphere substantially free of oxygen and having an outlet end and outlet end in communication with said waste outlet of said first housing;

(f) conveyor means mounted within said pipe for conveying waste material longitudinally thereof;

(g) a gas burner mounted within said second housing proximate said pipe for pyrolyzing the waste contained within said pipe;

(h) gas recovery means associated with said pipe for recovering gases produced from pyrolysis of the waste and for conveying said gases to said gas burner;

(i) solid material recovery means associated with said outlet of said pipe for recovering solid material therefrom; and (j) igniter means carried by said second housing for generating a coherent beam of light and directing it toward the waste material contained within said pipe said beam of light being of sufficient intensity to ignite the waste material.

2. A pyrolytic converter as defined in claim 1 in which a plurality of operably interconnected waste carrying conduits extend longitudinally of said first housing, each said conduit being in the path of microwaves generated by said microwave generator.

3. A pyrolytic converter as defined in claim 1 in which the waste material introduced into said first housing comprises a viscous liquid and in which said moving means comprises a mechanical pump for pumping said viscous liquid.

4. A pyrolytic converter as defined in claim 1 in which two operably interconnected pipes extend longitudinally of said second chambers in a substantially parallel orientation, each said pipe having conveyer means mounted therewithin.

5. A pyrolytic converter as defined in claim 4 in which said conveyer means comprises an elongated helical screw rotatably mounted within each of said two pipes.

6. A pyrolytic converter as defined in claim 4 in which said gas recovery means comprises first and second longitudinally extending gas recovering conduits operably interconnected with said two pipes and extending generally parallel thereto within said second housing, said gas recovery conduits being operably associated with said gas burner.

7. A pyrolytic converter for pyrolyzing waste sludge material comprising:

(a) an elongated first housing having first and second end portions, said first portion having a waste inlet and said second portion having a waste outlet;

(b) A plurality of interconnected waste carrying conduit extending longitudinally of said first housing, one of said conduits being in communication with said waste inlet of said first housing and one of said conduits being in communication with said waste outlet;

(c) pump means for moving the waste sludge material longitudinally of said waste carrying conduits;

(d) microwave generator means carried by said first housing for treating and dehydrating with microwaves the waste sludge material carried within said waste carrying conduits;

(e) an elongated, second housing having first and second end portions and having a pair of operably interconnected pipes extending longitudinally thereof, each said pipe containing an atmosphere substantially free of oxygen one said pipe having an outlet end, one said pipe having an inlet end in communication with said waste outlet of said first housing;

(f) an elongated helical screw rotatably mounted within each of said pipes for conveying the dehydrated waste material longitudinally thereof;

(g) a gas burner mounted within said second housing proximate said pipes for raising the temperature therewithin to a temperature sufficient to pyrolyze the dehydrated waste material contained within said pipes;

(h) gas recovery means associated with said pipes for recovering gases produced from pyrolysis of the dehydrated waste material for conveying said gases to said gas burner, said gas recovery means comprising a pair of longitudinally extending conduits contained within said second housing and extending generally parallel to said pair of operably interconnected pipes;

(i) solid material recovery means associated with said outlet of said pipe for recovering solid material therefrom; and (j) ignitor means carried by said second housing for generating a coherent beam of light and directing it toward the dehydrated waste contained within said pipes, said ignitor means comprising a molecular oscillator embodying a ruby and being of a character to generate a coherent beam of light of sufficient intensity to pyrolyze the dehydrated waste material.

8. A pyrolytic converter as defined in claim 7 in which said ignitor means is mounted on said first portion of said second housing and is arranged to direct intense beams of light longitudinally of said pipes to pyrolyze the dehydrated wasted carried therewithin.

9. A method of pyrolyzing organic waste material comprising the steps of:

(a) initially dehydrating the waste material by exposing the material to microwave radiation;

(b) exposing a first portion of the waste material to a coherent beam of light of sufficient intensity to ignite the material and to produce methane gas;
(c) collecting the methane gas produced through ignition of said first portion of the waste material;
(d) introducing a second portion of the waste material into a substantially oxygen-free atmosphere;
(e) burning the methane gas collected to pyrolyze said second portion of the waste material;
(f) collecting the volatile gases produced through pyrolysis of said second portion of the waste material;
(g) introducing a third portion of the waste material into a substantially oxygen-free atmosphere;
(h) burning the methane gas thus collected to pyrolyze said third portion of the waste material; and
(i) collecting the solid material produced through pyrolysis of the waste material.

10. A method of pyrolyzing organic waste material as defined in claim 9 in which said first portion of the waste material is ignited using a beam of high intensity light generated by a device for light amplification by simulated emission of radiation.

* * * * *